US005368476A

United States Patent [19]

Sugahara et al.

[11] Patent Number: 5,368,476

[45] Date of Patent: Nov. 29, 1994

[54] LOW-$NO_x$ GAS BURNER

[75] Inventors: Tatsuya Sugahara, Tokyo; Takao Takagi, Fuji; Kimio Mochizuki, Fujinomiya; Shigetoshi Akiyama, Fuji, all of Japan

[73] Assignees: Tokyo Gas Company Ltd., Tokyo; Takagi Ind. Co., Ltd., Fuji, both of Japan

[21] Appl. No.: 914,446

[22] Filed: Jul. 15, 1992

[51] Int. Cl.[5] ..... F23M 3/06; F23D 14/12

[52] U.S. Cl. ..... 431/285; 431/328

[58] Field of Search ..... 431/7, 326, 328, 354, 431/285, 278, 329

[56] References Cited

U.S. PATENT DOCUMENTS 5,093,106 12/1991 Toyonaga et al. ..... 431/328 X

FOREIGN PATENT DOCUMENTS 1065243 10/1979 Canada ..... 431/328
0451923 10/1991 European Pat. Off. ..... 431/328
2745687 4/1979 Germany ..... 431/278

*Primary Examiner*—Carl D. Price
*Attorney, Agent, or Firm*—Vineet Kohli

[57] ABSTRACT

A fuel-lean mixture burns in rows of flame ports each located between a pair of rows of flame ports burning a fuel-rich mixture. The fuel-rich flames support and stabilize the fuel-lean flames to stabilize combustion and to avoid flame liftoff and noise. The fuel-lean flames reduce the temperature of the overall flame, and thereby reduce the production of $No_x$ compounds produced by the burner. Stepwise and proportional burner control techniques are disclosed.

14 Claims, 4 Drawing Sheets

FIG. 1
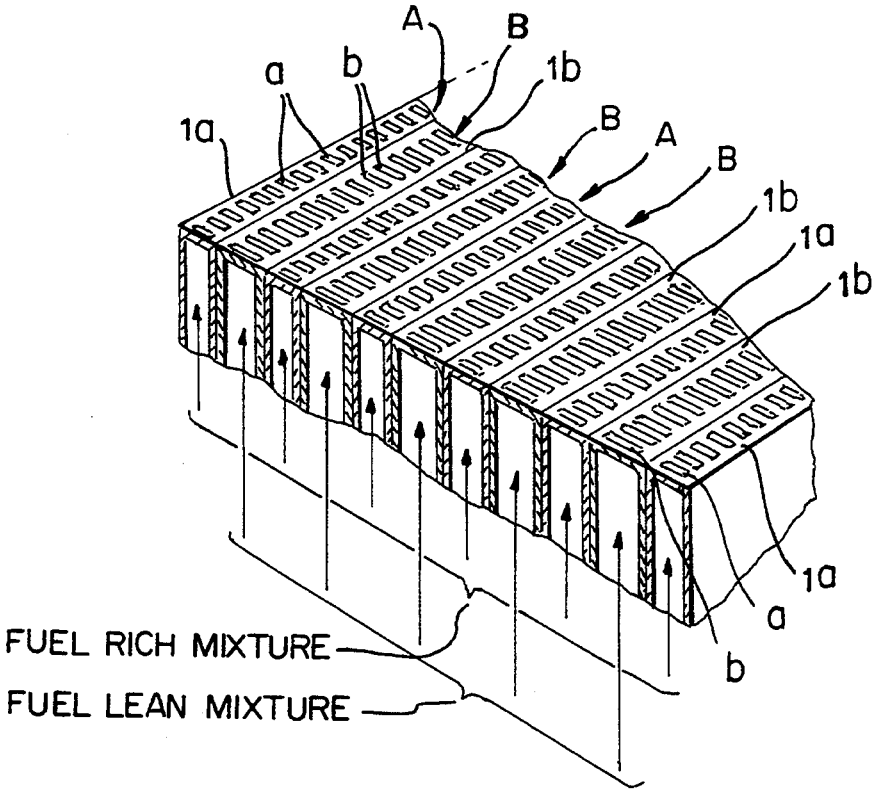
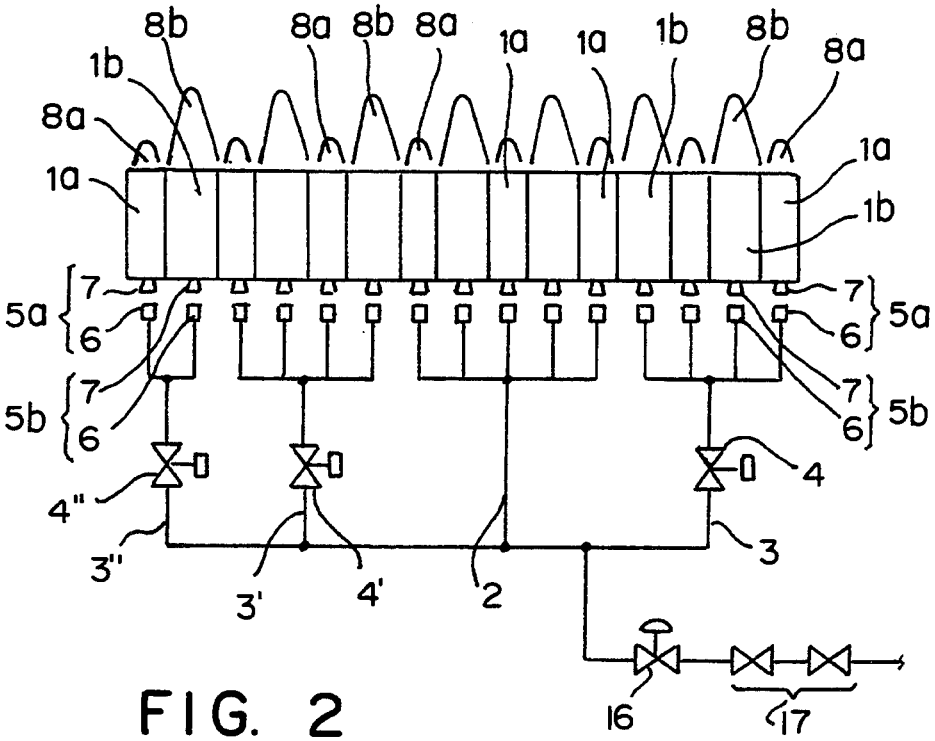
FIG. 2

LOW-$NO_x$ GAS BURNER

BACKGROUND OF THE INVENTION

The present invention relates to burners low in the generation of nitrogen oxides used in a small combustion apparatus for domestic or commercial.

Nitrogen oxides ($NO_x$) in the exhaust gases from burners of various combustion devices are toxic by themselves and are believed to cause acid rain and photochemical smog. Various measures for decreasing the generation of $No_x$ in burners of combustion apparatus have been developed and utilized.

However, these measures are mainly directed to solving the problems of legally regulated large combustion apparatuses for industrial and other use. Such measures are not satisfactory for small combustion apparatuses for domestic or small commercial use because of noise and/or cost problems.

In a large combustion apparatus, the large static pressure produced by the combustion fan permits easy flow control of the combustion gas and air. This permits a high degree of freedom of layout, and easy noise control. So, with easy control of noise, and with large combustion chambers a possibility, slow combustion can be used to decrease $No_x$ emissions while still achieving perfect combustion. These advantages are not available in small combustion devices. It is therefore difficult to attain decreases in $No_x$ emissions comparable to that which are attainable in large combustion systems.

OBJECTS AND SUMMARY OF THE INVENTION

It is therefore an object of the present invention to solve the above problem and to expand the control range of heat input, by rationally applying rich-lean combustion (bias combustion, off-stoichiometric combustion) to small combustion devices.

It is a further object of the invention to provide a small combustion apparatus which decreases the generation of $No_x$ without increasing noise.

It is a further object of the invention to provide a small combustion apparatus which permits stepwise control of combustion in a fuel-lean mixture.

It is a still further object of the invention to provide a small combustion apparatus which permits both stepwise and proportional control of combustion.

Briefly stated, the present invention provides a burner in which a fuel-lean mixture burns in rows of flame ports each located between a pair of rows of flame ports burning a fuel-rich mixture. The fuel-rich flames support and stabilize the fuel-lean flames to stabilize combustion and to avoid flame liftoff and noise. The fuel-lean flames reduce the temperature of the overall flame, and thereby reduce the production of $No_x$ compounds produced by the burner. Stepwise and proportional burner control techniques are disclosed.

According to an embodiment of the invention, there is provided burner comprising: a first flame port group, the first flame port group including at least a first row of flame ports, a second flame port group, the second flame port group including a second row of flame ports on a first side of the first row, and a third row of flame ports on a second side of the first row, whereby the first row is flanked on both sides by second flame port groups, a first fuel gas supply system supplying fuel gas at a first fuel-air mixture to the first flame port group, a second fuel gas supply system supplying fuel gas at a second fuel-air mixture to the second flame port group, the first fuel-air mixture being a fuel lean mixture, and the second fuel-air mixture being a fuel rich mixture.

According to a feature of the invention, there is provided a burner comprising: at least first, second and third sets of flame port groups, at least first, second and third fuel supply means for supplying fuel to the first, second and third sets of flame port groups, respectively, each of the first, second and third flame port groups including alternating rows of fuel rich flame ports and fuel lean flame ports, the first and third fuel supply means each including independent means for cutting off fuel flow to its respective set of flame port groups;, and the rows of fuel rich flame ports and the fuel lean flame ports being positioned so that, when any one of a combination of one, two and three of the first, second and third fuel supply means are supplying fuel to their respective sets of flame port groups, the two extreme outermost rows of flame ports are fuel rich flame ports.

According to a further feature of the invention, there is provided a burner comprising: a plurality of first and second flame port groups, each of the plurality including a row of flame ports, the first and second flame port groups being alternately adjacent to one another, one of the first flame port groups being located at both extreme ends of the first and second flame port groups, a first fuel gas supply system, the first fuel gas supply system feeding a portion of the first and second flame port groups beginning at one end of the burner to an intermediate position, a second fuel gas supply system, the second fuel gas supply system feeding the first and second flame port group beginning adjacent the intermediate position to an opposite end of the burner, the first and second fuel gas supply systems each including a fuel rich mixture producing means feeding its respective first flame port groups and fuel lean mixture producing means feeding its second flame port groups;, and means for independently cutting off the second fuel gas supply system.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is a perspective view showing flame port section of a burner according to an embodiment of the present invention.

FIG. 2 is a systematic illustration conceptually showing the entire constitution of the burner of the present invention.

DETAILED DESCRIPTION OF THE PREFERRED EMBODIMENT

Figure 3:
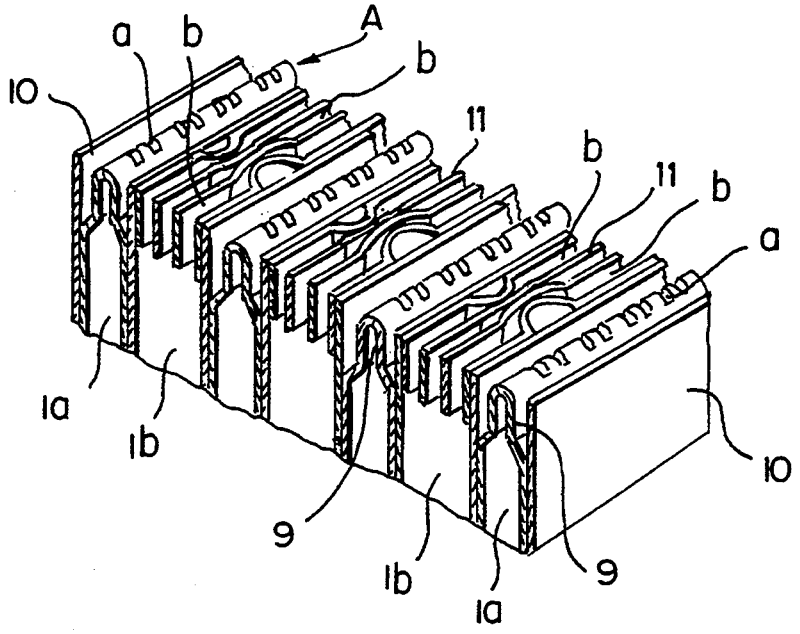
FIG. 3 is an illustrative perspective view showing the constitution of the flame port section in a further embodiment of the burner of the present invention.

Referring to FIGS. 1 and 2, a low-$No_x$ burner according to the present invention employs pluralities of first and second flame port groups A and B. Each flame port group A includes a row of flame ports a. Similarly, each flame port group B includes a row of flame ports b. Flame port groups A and B alternate with each other. The combination of flame port groups A and B make up a flame port section. The flame port groups at both extremes of a flame port section are flame port groups A.

A plurality of fuel gas supply systems 2, 3, 3' and 3" supply fuel gas to the flame port sections. Each of the plurality of fuel gas supply systems 2, 3, 3' and 3" includes a fuel rich mixture producing means 5*a* for feeding fuel gas to the first flame port groups A and a fuel lean mixture producing means 5*b* for feeding fuel gas to the second flame port groups B. The fuel gas supply systems are controlled to establish one of the first flame ports groups A at both extreme ends of its flame port section.

Fuel gas supply systems 2 and 3 each have fuel rich mixture producing means 5*a* corresponding to the first flame port groups A and fuel lean mixture producing means 5*b* corresponding to the second flame port groups B. Valves 4,4' and 4" permit independently cutting off respective fuel gas supply systems 3,3', and 3".

With two fuel gas supply systems 2 and 3, fuel gas from both the first and second gas supply systems 2 and 3 feed a rich fuel mixture through the fuel rich mixture producing means 5*a* to the flame ports a of first flame port groups A. The second flame port groups B receive a lean fuel mixture from fuel gas supply systems 2 and 3 through the fuel lean mixture producing means 5*b*. The fuel lean mixture exits the respective flame ports b for combustion.

The flames 8*b* in the second flame port groups B produced by the combustion of fuel lean mixture (that is, with a high ratio of air to fuel) are unstable. Thus, unstable burning would result from burning the air rich mixture alone. However, the flames 8*a* produced by the fuel rich mixture in the first flame port groups A are stable. Since the flames 8*b* are always adjacent on both their sides to the stable flames 8*a* produced by the fuel rich mixture in the first flame port groups A, the stable flames 8*a* act as pilot flames, to stabilize the flames 8*b* of the air rich mixture. This structure prevents flame lift of flames 8*b*. In addition, this structure prevents the oscillation of the flames, and thereby reduces noise.

The combustion of fuel lean mixture stabilized by the flames 8*a* alongside the fuel rich mixture flames 8*b* permits the cooling action of the air rich mixture to keep the temperature of the flames 8*b* low, thereby decreasing the generation of $NO_x$.

The fuel gas supply systems 3, 3' and 3" may be cut off independently, while leaving the first fuel gas supply system 2 turned on. It will be noted that flame ports a are located at extreme end positions fed by fuel gas supply system 2. This permits controlling the total flame port area stepwise while maintaining low $No_x$ production. Therefore, an adjustable range of heat input can be expanded.

Also in the combustion state as above, since each of the flames 8*b* of the second flame port groups B is adjacent on its both sides to the flames 8*a* of the first flame port groups A, the stabilizing action of flames 8*a* on flames 8*b* caused by the combustion of air rich mixture is not inhibited, and stable combustion of the air rich mixture decreases the generation of $NO_x$.

The stabilization of the flames 8*b* of the second flame port groups B by the flames 8*a* of the first flame port groups A can be achieved also when there exist three or more fuel gas supply systems 2, 3, 3' and 3", if a first flame port groups A is located at both ends of every range which it is desired to keep operating while shutting off fuel supply in adjacent fuel gas supply systems.

In the embodiment of FIG. 2, four fuel gas supply systems are provided; a first fuel gas supply system 2 has no control valve. Three second fuel gas supply systems 3, 3' and 3" have respective valves 4, 4' and 4". Fuel gas for these second fuel gas supply systems 3, 3' and 3" can be independently cut off by their respective valves 4, 4' and 4".

The flame port section corresponding to the first fuel gas supply system 2, has a first burner portions 1*a* located at each of its extreme ends. The adjacent flame port section fed by second fuel gas supply system 3, to the right in the drawing, a second burner portions 1*b* is located at its left end while a first burner portions 1*a* is located at the right-hand end. Thus, fuel gas supply systems 2 and 3 can be turned on while all of the other fuel gas systems are turned off while still providing a first burner portion 1*a* at both ends of the operating portions of the burner.

Similarly the adjacent flame port section fed by second fuel gas supply system 3', to the left of the drawing, one of the second burner portions 1*b* is located at the right-hand end while one of the first burner sections 1*a* is located at the left-hand end. Thus, the flame port section fed by second fuel gas supply system 3' can be turned on with the portion fed by first fuel gas supply system 2, or with the portions fed by first fuel gas supply system 2 and second fuel gas supply system 3.

Similarly the flame port section fed by the second fuel gas supply system 3" can be operated with those fed by fuel gas supply systems 3' and 2, and with those fed by 3', 2 and 3.

The burner combinations fed by the following combinations of fuel gas supply systems that can be employed:

Fuel gas supply system:

2
2+3
2+3'
2+3+3'
2+3+3'+3"

As is clear from the preceding, any combination of fuel gas supply systems is permitted as long as the result is a type-a flame at both ends of the active portion of the burner.

The respective fuel gas supply systems 2 and 3 supply air-fuel mixtures through the fuel mixture producing means 5 to the respective burner portions 1*a* and 1*b*. The air-fuel mixture producing means 5 consist of the fuel rich mixture producing means 5*a* for supplying a fuel rich mixture to the first burner portions 1*a* and the fuel lean mixture producing means 5*b* for supplying a fuel lean mixture to the second burner portions 1*b*. These air-fuel mixture producing means 5 can be constructed as Bunsen burner or other partially or fully premixed burners. In each of the air-fuel mixture producing means of this example, fuel gas is emitted from nozzle 6 into mixer tube 7, and is mixed with the air drawn into the mixer tube 7 by the flow of gas or by a blower. The mixing ratio of fuel gas and air can be adjusted by adjusting the diameter of the bore of nozzle 6. The air-fuel mixture producing means 5 permits easy adjustment of the fuel/air mixture produced by the fuel rich mixture producing means 5*a*, corresponding to the first burner portions 1*a*, and the fuel lean mixture producing means 5*b* corresponding to the second burner portions 1*b*.

In the above construction, if all of valves 4, 4' and 4'' are open, fuel gas is supplied from the first and second fuel gas supply systems 2, 3, 3' and 3'',and through the respective air-fuel mixture producing means 5, air-fuel mixtures are supplied to all the burner portions 1*a* and 1*b* for combustion. That is, the fuel gas through the first fuel gas supply system 2 is emitted from the nozzles 6 constituting the air-fuel mixture producing means 5*a* and 5*b* corresponding to the burner portions 1*a* and 1*b* of the system 2 into the mixer tubes 7 of the respective burner portions and mixed with the air sucked simultaneously, and at the flame port groups A and B, the air-fuel mixtures are emitted from the respective flame ports a and b. In this case, the fuel rich mixture producing means 5*a* corresponding to the respective first burner portions 1*a* produce the fuel rich mixture using the above mentioned adjustment, and the fuel lean mixture producing means 5*b* corresponding to the respective second burner portions 1*b* produce the fuel lean mixture. Also for the burner portions 1*a* and 1*b* corresponding to the second fuel gas supply system 3, the fuel rich mixture is supplied to the first burner portions 1*a* and the fuel lean mixture is supplied to the second burner portions 1*b* as described above.

For example, the air to fuel ratio for the fuel rich mixture may be adjusted to 1:0.4, and the fuel to air ratio may be adjusted to 1: 1.2 or 1:1.4 for the fuel lean mixture. Furthermore, the ratio of the fuel gas quantities supplied to the first and second burner portions 1*a* and 1*b* are adjusted to be in a ratio of about 3:7, to ensure that the quantity of fuel gas supplied to the second burner portions 1*b* is larger than that fed to the first burner portions 1*a*.

The above supply of the air-fuel mixtures form flames 8*a* by the combustion of the fuel rich mixture in the flame port groups A of all the first burner portions 1*a* constituting the burner and flames 8*b* by the combustion of fuel lean mixture in the flame port groups B of the second burner portions 1*b*, as shown by solid lines and two-dot-dash lines in FIG. 2. The first burner portions 1*a* and the second burner portions 1*b* are arranged adjacent to one another alternately, and one each of the first burner portions 1*a* is positioned at both the ends of the burner. So, each of the flames 8*b* of the second burner portions 1*b* has the flames 8*a* of the first burner portions 1*a* on both of its sides.

The flames 8*b* of the second burner portions 1*b* are unstable if they exist alone since they are formed by the combustion of an air rich mixture. However, since the flames 8*a* of the first burner portions 1*a* existing on both sides of the flames 8*b* are stable, they act as pilot flames, thus stabilizing the flames 8*b* of an air rich mixture. Therefore, the flames 8*b* of the second burner portions 1*b* avoid the lift and oscillating combustion characteristic of a fuel lean mixture, thus avoiding the instability and noise usually accompanying the burning of a fuel lean mixture.

The combustion of the fuel lean mixture stabilized by the flames 8*a* of fuel rich mixture results in a combination in which the combustion temperature produced by the combustion of air rich mixture is reduced by the presence of the fuel lean mixture, thereby reducing the generation of $NO_x$.

If the valve 4 is closed, to cut off the supply of fuel gas fed through the second fuel gas supply system 3, the flames of the burner portions 1*a* and 1*b* fed by the fuel gas supply system 3 are extinguished, and only the burner portions corresponding to the flames shown by solid lines in FIG. 2 continue burning.

Then, if the supply of fuel gas through the second fuel gas supply system 3'' is also cut off, the flames of the two burner portions 1*a* and 1*b* on the left-hand side corresponding to the system 3'' are extinguished. In addition, if the supply of fuel gas through the second fuel gas supply system 3' is also cut off, the flames of the four burner portions 1*a* and 1*b* corresponding to the system 3' are extinguished.

In any case of the above combustion states, since each of the flames 8*b* of the second burner portions 1*b* has flames 8*a* of the first burner portions 1*a* on its both sides, the flames 8*b* of the second burner portions 1*b* are stabilized by the flames 8*a* of the first burner portions 1*a* as described before.

To ensure such stabilization action, in this example, when the burner portions 1*a* and 1*b* fed by the fuel gas supply system 3'' are engaged in combustion, the flames of the burners 1*a* and 1*b* fed by the fuel gas supply system 3' must remain burning.

In this way, the active flame port area engaged can be changed stepwise without inhibiting the action of stabilizing the flames 8*b* of the second burner portions 1*b* by the flames 8*a* of the first burner portions 1*a*. Therefore, the heat input can be adjusted in a wide range using any known combustion quantity control method such as proportional control.

In the example described above, the flame port area can be changed in four steps. It is, of course, possible to provide more or less than four steps of change in the flame port area. In the above example, the fuel gas supply systems 2 and 3 and the corresponding burner portions 1*a* and 1*b* only, or the fuel gas supply systems 2 and 3' and the corresponding burner portions 1*a* and 1*b* only may be used.

In addition to the step-wise control discussed above, proportional control of all active flame ports can be achieved. A proportional control valve 16 and master valves 17, feeding all fuel gas control systems, permit simultaneous proportional control of fuel gas. Such proportional control, combined with the stepwise control described above, provides a complete range of control for heat generation.

Figure 4:
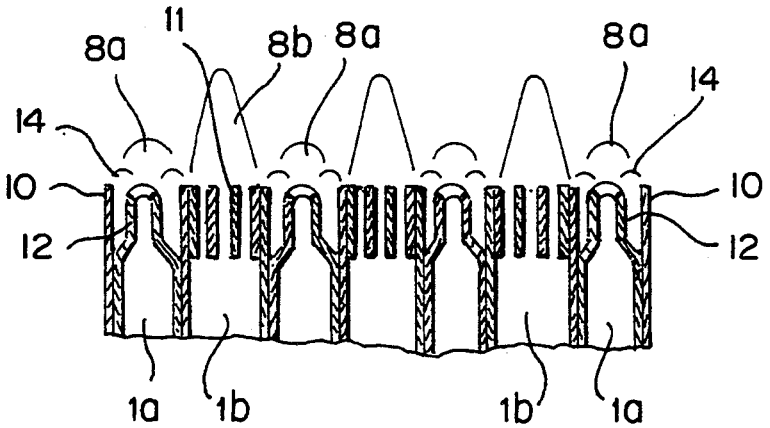
FIG. 4 is an illustrative sectional view illustrating the combustion state of the burner of FIG. 3.

Referring now to FIGS. 3 and 4, a further embodiment of the present invention includes first burner portions la that narrow down at their tip portions 9 and that have slit-like flame ports at their tops. Side walls 10 extend above wider lower portions of these burner portions to provide spaces between the side walls 10 and tip portions 9. The second burner portions 1*b* have ribbons 11 installed at their tips, to form many flame ports b. As best shown in FIG. 4, the tip spout portions 9 of the first burner portions 1*a* can have flame retention port 12 formed on their sides as required.

Figure 5:
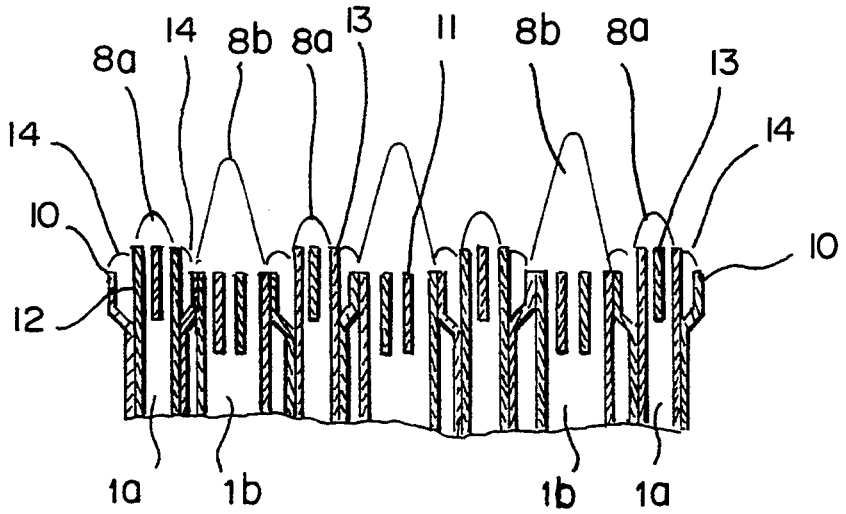
FIG. 5 is an illustrative sectional view showing the constitution of the flame port section in the burner of the present invention.

Referring now to FIG. 5 a burner according to a further embodiment of the invention includes first burner portions 1*a* have ribbons 13 installed at their tips to form many flame ports a as is done with the second burner portions 1b. Flame retention holes 12 a formed in the ribbons of flame ports a, and flame retention side walls 10 are disposed outside these ribbons spaced therefrom to provide spaces therebetween.

In the above-described burner, the generation of noise can be further inhibited by the air-fuel mixture flow guide action at the flame ports a and b formed by the ribbons 11 and 13, in addition to the action as described for the embodiments of FIGS. 1 and 2. Furthermore, when retained flames 14 are formed at the first burner portions l*a*, not only the flames 8*a* of the first burner portions themselves but also the flames 8*b* of the second burner portions 1*b* can be further stabilized.

Figure 6:
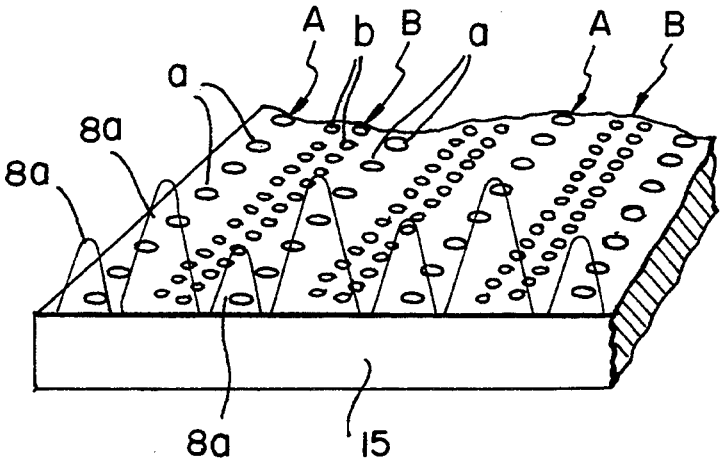
FIG. 6 is an illustrative perspective view showing the constitution of the flame port section in the burner of the present invention.

Referring now to FIG. 6, a ceramic plate 15 having many flame ports a and b formed therein a ceramic plate 15. That is, the ceramic plate 15 has may flame ports formed in straight rows, to form the first and second flame port groups A and B alternately arranged. The flame ports b of the second flame port groups B are smaller in diameter and more in number than the flame ports a of the first flame port groups A. In the illustrated example, each of the second flame port groups B is formed by many small flame ports b arranged in two rows.

In the above embodiment, the combustion in flame ports b of the second flame port groups B is of an air rich mixture as described before, and the combustion is divided into many small-diameter flame ports b. This division of the flames into many small flames further reduces the temperature of the flames 8*b*, thus further decreasing the generation of $NO_x$. Furthermore, since the flames 8*b* are stabilized by the flames 8*a* of the fuel rich mixture from the flame ports a of the first flame port groups A, as in the other examples described before, lift and oscillating combustion are inhibited.

Figure 7:
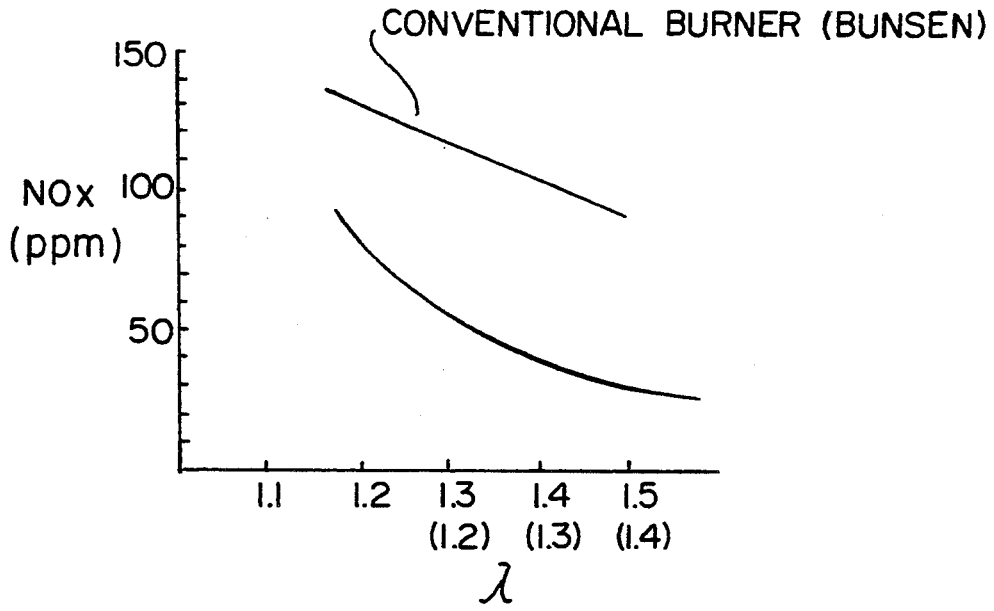
FIG. 7 is a diagram showing the $No_x$ concentration generated by the burner of the present invention in comparison with the conventional Bunsen burner.

FIG. 7 shows the $No_x$ emission characteristics of the burner of the embodiment of the present invention shown in FIG. 1. The diagram shows the relation between the air ratio of the burner shown on the abscissa achieved by adjusting the air ratio of the fuel lean mixture, and the quantity of $No_x$ generated by such burning while the air ratio of the fuel rich mixture is set at 0.4 to 0.7. The indicated air ratio values include the cooling air which may be fed around the burner. The parenthesized air ratio values show the values not including the cooling air. The ratio of the heat input by the fuel lean mixture to the heat input by the fuel rich mixture is 7.5:2.5.

From FIG. 7, it can be seen that the burner of the present invention is remarkably lower in the generation of $No_x$ than a conventional general Bunsen burner.

Figure 8:
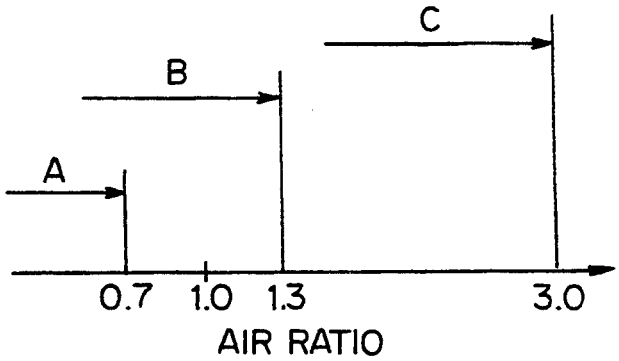
FIG. 8 is an illustration showing the lift limit of the flames of the burner portions or flame port groups supplied with the fuel lean mixture in the burner of the present invention, in comparison with others.

FIG. 8 shows the lift limit of the flames by the burner portions or flame port groups supplied with the fuel lean mixture in the present invention, as an example in comparison with others.

Symbol A shows the lift limit of the second burner portions 1*b* achieved when the fuel lean mixture is supplied to the flame ports b of the second burner portions 1*b* or the flame port groups B without the flame retention by the flames 8*a* of the fuel rich mixture by the first burner portions 1*a* or the flame port groups A in the burner of the present invention, and the limit is about 0.7. On the contrary, symbol B shows the lift limit in the conventional general Bunsen burner with a flame retention mechanism. This limit is about 1.3. Symbol C shows the lift limit of the second burner portions 1*b* when both the first and second burner portions 1*a* and 1*b* of the flame port groups A and B are used for combustion in the burner of the present invention. This limit is about 3.0.

From the above, it can be seen that the burner of the present invention allows stable combustion of a very air rich mixture compared to the conventional general Bunsen burner and decreases the $No_x$ generated.

As described above, in the present invention, since the combustion of a highly air rich mixture (fuel lean mixture), which is unstable in itself, is stabilized by the stable flames produced by the combustion of fuel rich mixture, the combustion of air rich mixture can be stabilized effectively and the generation of $No_x$ can be decreased.

Furthermore, since the combustion of an air rich mixture is stabilized, the $No_x$ reduction is accomplished without the generation of noise. Thus, a small combustion apparatus can be made in which the generation of $No_x$ is reduced without increasing noise.

Moreover, the flame port area as a whole can be changed stepwise without disturbing the stabilized combustion of air rich mixture, and thus, the adjustable range of heat input can be expanded.

(Constitution)

Comprising respectively plural first and second flame port groups A and B, each with a row of flame ports a and b, being arranged alternately adjacently to one another, with one each of the first flame port groups A located at both the extreme ends of the arranged first and second flame port groups, to constitute a flame port section; plural fuel gas supply systems 2, 3, 3' and 3'', being provided to supply fuel gas to the flame port section; and each of the plural fuel gas supply systems 2, 3, 3' and 3'', being provided with fuel rich mixture producing means corresponding to the first flame port groups and fuel lean mixture producing means corresponding to the second flame port groups, and being controlled to locate one each of the first flame port groups at both the extreme ends in the range of the flame port section to be supplied with the fuel gas from each of the fuel gas supply systems.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A burner comprising:

a plurality of first burner portions;

each of said plurality, of first burner portions including at least a row of flame ports;

at least one second burner portion;

each said at least one second burner portion including at least a row of flame ports;

each of said at least one second burner portion being located between a pair of said plurality of first burner portions;

a fuel gas supply system supplying fuel gas to each said plurality of first burner portions and to each of said at least one second burner portion;

said fuel gas supply system supplying a rich mixture of fuel gas to each of said plurality of first burner portions;

said fuel gas supply system supplying a lean mixture of fuel gas to each of said at least one second burner portion; and means for controlling said fuel gas supply including means for providing a combination of continuous and stepwise control of heat output of said burner.

2. A burner comprising:

a plurality, of first burner portions having flame ports;

said flame ports of each of said plurality of first burner portion arranged in a row;

at least one second burner portion having flame ports;

said flame ports of each said at least one second burner portion arranged in a plurality of rows:

said plurality of first burner portions and said at least one second burner portion being arranged alternately with each other;

each of said at least one second burner portion being located between a pair of said plurality of first burner portions;

a fuel gas supply system to supply fuel gas to each said plurality of first and said at least one second burner portions;

said fuel gas supply system supplying a rich mixture of fuel gas to each said plurality of first burner portions; and said fuel gas supply system supplying a lean mixture of fuel gas to each of said at least one second burner portion.

3. A burner comprising:

a plurality of first burner portions;

each of said plurality of first burner portions having at least one row of fame ports;

said plurality of first burner portions for receiving a rich mixture of fuel gas;

a plurality of second burner portions;

each of said plurality of second burner portions having at least one row of flame ports;

said plurality of second burner portions for receiving a lean mixture of fuel gas;

said plurality of first burner portions and said plurality of second burner portions being arranged alternately with each other;

each of said plurality of second burner portions being located between a pair of said plurality of first burner portions;

at least first, second and third sets of flame port sections;

at least first, second and third fuel supply means for supplying fuel to said first, second and third sets of flame port sections, respectively;

each of said first, second and third sets of flame port sections including a part of said plurality of first and second burner portions;

said first and third fuel supply means each include independent means for cutting off a fuel flow to its respective set of flame port sections;

each said part of said plurality of first and second burner portions being positioned within each of said first, second and third flame port sections so that, when any one of a combination of one, two and three of said first, second and third fuel supply means are supplying fuel to their respective sets of flame port sections, the two extreme outermost burner portions of said supplied flame port sections are of said plurality of first burner portions.

4. A burner comprising:

a plurality of first burner portions;

each of said plurality of first burner portions having at least one row of flame ports;

said plurality of first burner portions for receiving a rich mixture of fuel gas;

a plurality of second burner portions;

each of said plurality of second burner portions having at least one row of flame ports;

said plurality of second burner portions for receiving a lean mixture of fuel gas;

said plurality of first burner portions and said plurality of second burner portions being arranged alternately with each other;

each of said plurality of second burner portions being located between a pair of said plurality of first burner portions;

at least first, second and third sets of flame port sections;

at least first, second and third fuel supply means for supplying fuel to said first, second and third sets of flame port sections, respectively;

each of said first, second and third sets of flame port sections including a part of said plurality of first and second burner portions;

said first and third fuel supply means each include independent means for cutting off a fuel flow to its respective set of flame port sections;

each of said plurality of first and second burner portions being positioned within each of said first second and third flame port sections so that, when any one of a combination of one, two and three of said first, second and third fuel supply means are supplying fuel to their respective sets of flame port sections, the two extreme outermost burner portions of said supplied flame port sections are of said plurality of first burner portions;

said second set of flame port sections is positioned between said first and third flame port sections;

said second set of flame port sections includes one of said plurality of first burner portions at each of its extreme ends;

said first set of flame port sections includes one of said plurality of second burner portions at its end contiguous to said first set of flame port sections, and one of said plurality of first burner portions at its opposite end; and said third set of flame port sections includes one of said plurality of second burner portions at its end contiguous to said second set of flame port sections, and one of said plurality of first burner portions at its opposite end, whereby said second set of flame port sections can be turned on by itself, said first and second sets of flame port sections can be turned on together, said second and third sets of flame port sections can be turned on together, and said first, second and third sets flame port sections can be turned on together, thereby providing a stepwise control of a heat output of said burner.

5. A burner comprising:

a plurality of first burner portions;

each of said plurality of first burner portions having at least one row of flame ports;

said plurality of first burner portions for receiving a rich mixture of fuel gas;

a plurality of second burner portions;

each of said plurality of second burner portions having at least one row of flame ports;

said plurality of second burner portions for receiving a lean mixture of fuel gas;

said plurality of first burner portions and said plurality of second burner portions being arranged alternately with each other;

each of said plurality of second burner portions being located between a pair of said plurality of first burner portions;

at least first, second and third sets of flame port sections;

at least first, second and third fuel supply means for supplying fuel to said first, second and third sets of flame port sections, respectively;

each of said first, second and third sets of flame port sections including a part of said plurality of first and second burner portions;

said first and third fuel supply means each include independent means for cutting off a fuel flow to its respective set of flame port sections;

each of said plurality of first and second burner portions being positioned within each of said first second and third flame port sections so that, when any one of a combination of one, two and three of said first, second and third fuel supply means are supplying fuel to their respective sets of flame port sections, the two extreme outermost burner portions of said supplied flame port sections are of said plurality of first burner portions;

said second set of flame port sections is positioned between said first and third flame port sections;

said second set of flame port sections includes one of said plurality of first burner portions at each of its extreme ends;

said first set of flame port sections includes one of said plurality of second burner portions at its end contiguous to said first set of flame port sections, and one of said plurality of first burner portions at its opposite end; and said third set of flame port sections includes one of said plurality of second burner portions at its end contiguous to said second set of flame port sections, and one of said plurality of first burner portions at its opposite end, whereby said second set of flame port sections can be turned on by itself, said first and second sets of flame port sections can be turn on together, said second and third sets of flame port sections can be turned on together, and said first, second and third sets flame port sections can be turned on together, thereby providing a stepwise control of a heat output of said burner; and said first, second and third fuel supply means further includes proportional means for controlling said fuel flow to all of said sets of flame port sections, thereby providing a combination of continuous and stepwise control of heat output of said burner.

6. A burner comprising:

a plurality of first burner portions;

each of said plurality of first burner portions having at least one row of flame ports;

said plurality of first burner portions for receiving a rich mixture of fuel gas;

a plurality of second burner portions;

each of said plurality of second burner portions having at least one row of flame ports;

said plurality of second burner portions for receiving a lean mixture of fuel gas;

said plurality of first burner portions and said plurality of second burner portions being alternately adjacent to one another;

one each of the plurality of first burner portions being located at both extreme ends of all of said pluralities of first and second burner portions;

a first fuel gas supply system;

said first fuel gas supply system feeding a part of said plurality, of first and second burner portions beginning at one end of said burner, to an intermediate position, which has a one of said plurality of first burner portions;

a second fuel gas supply system;

said second fuel gas supply system feeding a part of said plurality, of first and second burner portions beginning adjacent said intermediate position and extending to an opposite end of said burner;

said first and second fuel gas supply systems each including a fuel rich mixture producing means for feeding its respective ones of said plurality of first burner portions and a fuel lean mixture producing means for feeding its respective ones of said plurality of second burner portions; and means for independently cutting off said second fuel gas supply system.

7. A burner comprising:

a plurality of first burner portions;

each of said plurality of first burner portions having at least one row of flame ports;

said plurality of first burner portions for receiving a rich mixture of fuel gas;

a plurality of second burner portions;

each of said plurality of second burner portions having at least one row of flame ports;

said plurality of second burner portions for receiving a lean mixture of fuel gas;

said plurality of first burner portions and said plurality of second burner portions being alternately adjacent to one another;

one each of the plurality of first burner portions being located at both extreme ends of all of said pluralities of first and second burner portions;

a first fuel gas supply system;

said first fuel gas supply system feeding a part of said plurality of first and second burner portions beginning at one end of said burner, to an intermediate position, which has a one of said plurality of first burner portions;

a second fuel gas supply system;

said second fuel gas supply system feeding a part of said plurality of first and second burner portions beginning adjacent said intermediate position and extending to an opposite end of said burner;

said first and second fuel gas supply systems each including a fuel rich mixture producing means for feeding its respective ones of said plurality of first burner portions and a fuel lean mixture producing means for feeding its respective ones of said plurality of second burner portions;

means for independently cutting off said second fuel gas supply system; and said fuel rich producing means and said fuel lean producing means includes a plurality of mixer tubes; a plurality of nozzles injecting said fuel gas into a respective one of said plurality of mixer tubes; and means for permitting air to be sucked into said mixer tubes together with said fuel gas, whereby a fuel rich or a fuel lean mixture is produced in said mixer tubes.

8. A burner comprising;

a plurality, of first burner portions;

each of said plurality of first burner portions having at least one row of flame ports;

said plurality of first burner portions for receiving a rich mixture of fuel gas;

a plurality of second burner portions;

each of said plurality of second burner portions having at least one row of flame ports;

said plurality of second burner portions for receiving a lean mixture of fuel gas;

said plurality of first burner portions and said plurality of second burner portions being arranged alternately with each other;

each of said plurality of second burner portions being located between a pair of said plurality of second burner portions; and said plurality of first and second burner portions being flanked on both ends with said first burner portions.

9. A burner according to claim 8, wherein:

a fuel gas supply system supplies a fuel gas to said plurality of first and second burner portions;

said fuel gas supply system includes means for producing a fuel rich gas mixture to said plurality of first burner portions and a fuel lean gas mixture to said plurality of second burner portions.

10. A burner according to claim 9, wherein said means for producing said fuel rich mixture and said fuel lean mixture includes:

a plurality of mixer tubes;

a plurality of nozzles injecting said fuel gas into a respective one of said plurality of mixer tubes; and means for permitting air to be sucked into said mixer tubes together with said fuel gas, whereby one of a fuel rich and a fuel lean mixture is produced in respective ones of said mixer tubes.

11. A burner according to claim 9, wherein:

each of said plurality of first burner portions has a first tip;

each of said first tips is narrow and has slit-like flame ports;

each of said plurality of second burner portions has a second tin; and each of said second tips includes ribbons which form many flame ports.

12. A burner according to claim 9, wherein:

each of said plurality, of first burner portions has a first tip;

each of said first tips include ribbons;

each of said first tips also include flame retention side walls;

said flame retention side walls are located on either side of said ribbons to form a space between said ribbons and said flame retention side walls.

13. A burner according to claim 9, further comprising means for changing a combustion quantity.

14. A burner according to claim 13, wherein said means for changing operates by one of a step-wise and a proportional control.

* * * * *